US006998591B2

(12) United States Patent
Ito et al.

(10) Patent No.: US 6,998,591 B2
(45) Date of Patent: Feb. 14, 2006

(54) HIGH FREQUENCY HEATING APPARATUS WITH DISPLACEMENT IDENTIFIABLE REMAINING HEATING DURATION AND PHASE CONTROL BASED THEREON

(75) Inventors: Kohei Ito, Izumi (JP); Koji Ueda, Minoo (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/505,921

(22) PCT Filed: Mar. 3, 2003

(86) PCT No.: PCT/JP03/02446

§ 371 (c)(1),
(2), (4) Date: Jan. 24, 2005

(87) PCT Pub. No.: WO03/075614

PCT Pub. Date: Sep. 12, 2003

(65) Prior Publication Data

US 2005/0121441 A1 Jun. 9, 2005

(30) Foreign Application Priority Data

Mar. 4, 2002 (JP) ..... 2002-057288
Feb. 25, 2003 (JP) ..... 2003-046777

(51) Int. Cl.
*H05B 6/68* (2006.01)

(52) U.S. Cl. ..... 219/702; 219/716; 219/719

(58) Field of Classification Search ..... 219/715–721, 219/702

See application file for complete search history.

(56) References Cited

U.S. PATENT DOCUMENTS 3,780,252 A * 12/1973 Crapuchettes ..... 219/716
4,300,032 A * 11/1981 Niu et al. ..... 219/716
4,524,258 A 6/1985 Aoki
4,539,453 A 9/1985 Miyazaki et al.

FOREIGN PATENT DOCUMENTS

JP 53-29001 A 3/1978
JP 59-219891 12/1984
JP 59-228393 A 12/1984
JP 61-7589 A 1/1986
JP 63-284791 A 11/1988
JP 11-83023 A 3/1999

OTHER PUBLICATIONS

International Search Report for corresponding PCT/JP03/02446, mailed Jun. 24, 2003.

* cited by examiner

*Primary Examiner*—Philip H. Leung
(74) *Attorney, Agent, or Firm*—Renner, Otto, Boisselle & Sklar, LLP

(57) ABSTRACT

In a high frequency heating apparatus, a microcomputer inputs the phase signal of a commercial AC power supply and determines whether a timer switch in a mechanical timer apparatus is in ON-state to determine whether the high frequency heating apparatus is in a heating-time set state. If so, the microcomputer turns on a switch that controls the conduction between the commercial AC power supply and a high voltage transformer at such a timing that minimizes the rush current in accordance with the phase of the commercial AC power supply, thereby suppressing the rush current, allowing the user to visually confirm the remaining heating time, and realizing a cost reduction.

16 Claims, 6 Drawing Sheets

FIG. 6 *PRIOR ART*
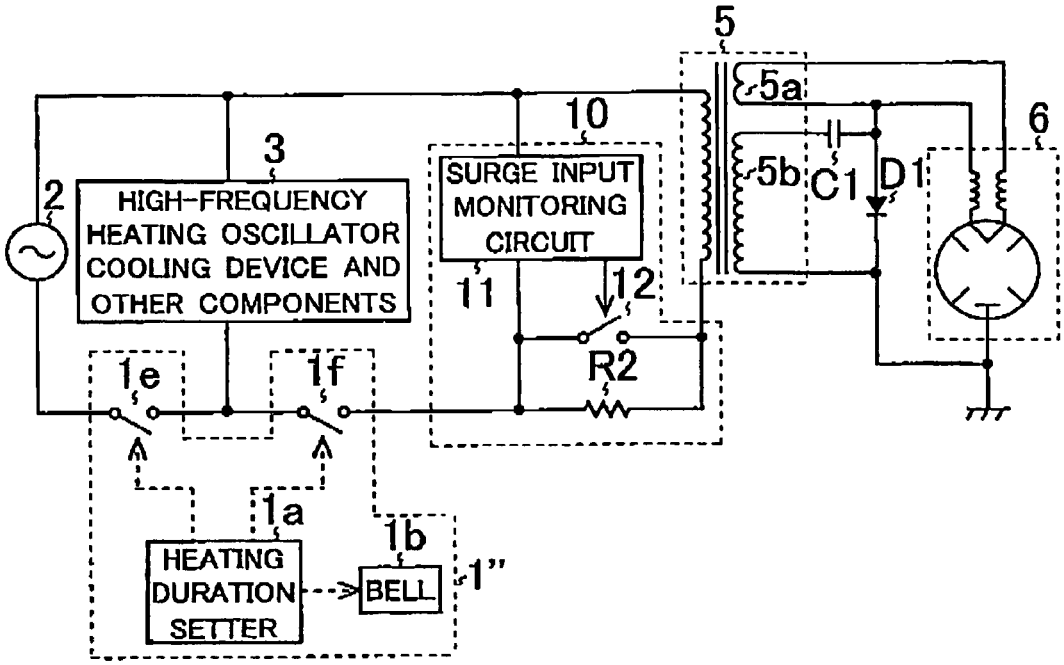

HIGH FREQUENCY HEATING APPARATUS WITH DISPLACEMENT IDENTIFIABLE REMAINING HEATING DURATION AND PHASE CONTROL BASED THEREON

TECHNICAL FIELD

The present invention relates to a high-frequency heating apparatus. More particularly, the present invention relates to a high-frequency heating apparatus in which a heating duration is set by means of a time-limiting device including a mechanical switch (hereinafter referred to as a mechanical time-limiting device).

BACKGROUND ART

As an example of a conventional high-frequency heating apparatus, a microwave oven will be described below. An example of the configuration of a conventional microwave oven is shown in FIG. 6. A mechanical time-limiting device 1" has the following components assembled into a unit: a heating duration setter 1*a*, a bell 1*b*, a mechanical switch functioning as a time-limiting switch 1*e*, and a mechanical switch functioning as a time-limiting switch 1*f*. One end of commercial alternating-current power source 2 is connected via the time-limiting switch 1*e* to one end of the time-limiting switch 1*f*. The other end of the time-limiting switch 1*f* is connected via a surge circuit 10 to one end of a primary coil of a high-voltage transformer 5. On the other hand, the other end of the commercial alternating-current power source 2 is connected directly to the other end of the primary coil of the high-voltage transformer 5.

The surge circuit 10 is composed of a surge input monitoring circuit 11, a switch 12, and a resistor R2. One end of the surge input monitoring circuit 11, one end of the switch 12, and one end of the resistor R2 are connected to the time-limiting switch 1*f*. The other end of the switch 12 and the other end of the resistor R2 are connected to the primary coil of the high-voltage transformer 5. The other end of the surge input monitoring circuit 11 is connected to the node between the other end of the commercial alternating-current power source 2 and the other end of the primary coil of the high-voltage transformer 5.

Moreover, one end of electric circuitry 3 (hereinafter referred to as the high-frequency heating oscillator cooling device and other components 3) including components—such as an oven lamp for illuminating the interior of a heating chamber, a turntable motor for rotating a turntable, and a fan motor for cooling a magnetron 6—that need to be operated as high-frequency heating is performed is connected to the node between the time-limiting switches 1*e* and 1*f*. Moreover, the other end of the high-frequency heating oscillator cooling device and other components 3 is connected to the node between the other end of the commercial alternating-current power source 2 and to the other end of the primary coil of the high-voltage transformer 5.

Next, the components connected to the secondary side of the high-voltage transformer will be described. Between the anode and cathode of the magnetron 6 is connected a diode D1 in parallel therewith. Specifically, to the anode of the magnetron 6 is connected the cathode of the diode D1, and to the cathode of the magnetron 6 is connected the anode of the diode D1. Moreover, to the cathode of the magnetron 6 is connected a secondary coil 5*a* of the high-voltage transformer 5. Furthermore, to the anode of the diode D1 is connected, via a capacitor C1, one end of a secondary coil 5*b* of the high-voltage transformer 5, and to the cathode of the diode D1 is connected the other end of the secondary coil 5*b*. The anode of the magnetron 6 is grounded.

Now, the operation of the microwave oven configured as described above will be described. The heating duration setter 1*a* has a rotary knob (not illustrated). When the user rotates the rotary knob clockwise, the heating duration setter 1*a* sets a heating duration commensurate with the amount of rotation. As the heating duration passes by, the rotary knob rotates counter-clockwise by a rotation angle commensurate with the lapsed time, thereby indicating the remaining heating duration on an analog basis. The time-limiting switch 1*e* remains on during the heating duration, and otherwise remains off. On the other hand, the time-limiting switch 1*f*, during the heating duration, toggles between on and off with a duty factor determined by the motor and gear-and-cam mechanism (not illustrated) incorporated in the heating duration setter 1*a*, and otherwise remains off. At the end of the heating duration, the bell 1*b* sounds.

When the time-limiting switch 1*e* is on, i.e. during the heating duration, electric power is supplied from the commercial alternating-current power source 2 to the high-frequency heating oscillator cooling device and other components 3, so that the high-frequency heating oscillator cooling device and other components 3 operate.

When the time-limiting switch 1*e* is on and the time-limiting switch 1*f* is on, electric power is supplied from the commercial alternating-current power source 2 to the high-voltage transformer 5, so that a high voltage of about 4 kV appears at the secondary side of the high-voltage transformer 5. This high voltage is supplied to the magnetron 6, so that the magnetron 6 oscillates a microwave. A target to be heated is irradiated with this microwave, and is thereby heated. Here, through the time-limiting switches 1*e* and 1*f* flows a current that is needed to achieve microwave heating, and therefore the time-limiting switches 1*e* and 1*f* need to be mechanical switches through which a current of at least 15 A can be passed. On the other hand, when the time-limiting switch 1*e* is on and the time-limiting switch 1*f* is off, no electric power is supplied from the commercial alternating-current power source 2 to the high-voltage transformer 5, so that the magnetron 6 oscillates no microwave. Thus, the microwave output is determined by the duty factor mentioned above.

If the timing with which the time-limiting switch 1*f* turns from off to on is not in synchronism with the phase of the commercial alternating-current power source 2, the exciting current of the high-voltage transformer 5 may produce a large rush current, over 100 A in the worst case. It is for this reason that, in the conventional microwave oven shown in FIG. 6, which cannot bring the timing with which the time-limiting switch 1*f* turns from off to on into synchronism with the phase of the commercial alternating-current power source 2, the surge circuit 10 is provided with a view to suppressing rush current.

The switch 12 is controlled by the surge input monitoring circuit 11 so as to be normally on, short-circuiting the resistor R2. The surge input monitoring circuit 11 monitors the value of the rush current, and, when the monitored rush current becomes higher than a threshold value, keeps the switch 12 off for a predetermined period. When the switch 12 is off, the rush current is branched via the resistor R2, reducing the effect thereof.

It is true that providing the surge circuit 10 as described above helps reduce rush current. However, even the surge circuit 10 cannot minimize rush current, and thus a heavy burden remains imposed on the time-limiting switch 1*f*, through which a large rush current flows as usual when it turns from off to on.

Moreover, the surge circuit 10 is composed of rather large components. Thus, even in a microwave oven provided with a circuit board on which to mount electric components, unlike the other components mounted thereon, the surge circuit 10 is not mounted on the circuit board, but is fitted to the main unit of the microwave oven. This necessitates an extra step of fitting the surge circuit in the manufacturing procedure, and thus hinders cost reduction. Moreover, the large components of the surge circuit 10 hinders size reduction.

On the other hand, there have conventionally been known also high-frequency heating apparatuses, for example the one disclosed in Japanese Patent Application Laid-Open No. S63-205088, in which a switch for controlling the supply of electric power to a high-voltage transformer is controlled by a microcomputer so as to reduce rush current. However, this type of high-frequency heating apparatus is not provided with a mechanical time-limiting device that permits the user to visually recognize the remaining heating duration in the form of the amount of rotation of a rotary knob. Thus, to permit the user to visually recognize the remaining heating duration, it is necessary to additionally provide a display device such as a liquid crystal display. Additionally providing such a display device leads to higher cost.

DISCLOSURE OF THE INVENTION

In view of the above problems, it is an object of the present invention to provide an inexpensive high-frequency heating apparatus that can reduce rush current and that permits the user to visually recognize the remaining heating duration.

To achieve the above object, in one aspect of the present invention, a high-frequency heating apparatus is provided with: a high-frequency oscillator; a high-voltage transformer that supplies electric power appearing at the secondary side thereof to the high-frequency oscillator; switching means that supplies electric power to the primary side of the high-voltage transformer; a time-limiting device including heating duration setting means that permits a heating duration to be set according to the amount of displacement by which the heating duration setting means is displaced progressively and that is displaced retrogressively as the heating duration passes by, and a time-limiting switch that turns from off to on when the heating duration is set and that turns from on to off when the amount of displacement returns to the initial value; phase monitoring means that monitors the phase of the supply voltage; and controlling means that is fed with electric power when the time-limiting switch is on and that controls the switching means according to the phase of the supply voltage as monitored by the phase monitoring means.

With this configuration, the provision of the controlling means that controls the switching means according to the phase of the supplied voltage helps reduce rush current. This permits the switching means to have a lower rated current capacity, and thus helps achieve lower cost. Moreover, the time-limiting device permits the remaining heating duration to be indicated on an analog basis, and thus eliminates the need to provide a display device. In this way, it is possible to realize an inexpensive high-frequency heating apparatus that permits the user to visually recognize the remaining heating duration. Furthermore, electric power is supplied to the controlling means when the time-limiting switch is on, and no electric power is supplied to the controlling means when the time-limiting switch is off. This helps eliminate the stand-by power consumption of the controlling means.

Advisably, when the controlling means judges the time-limiting switch to be off with respect to the value of the voltage supplied when the time-limiting switch is on, the controlling means turns off the switching means according to the phase of the supply voltage as monitored by the phase monitoring means.

Thus, it is possible, without the provision of separate detecting means for detecting whether or not the time-limiting switch is on, to prevent electric discharge from occurring at the contacts of the switching means when the switching means turns from on to off to stop the supply of electric power to the high-frequency oscillator.

Alternatively, detecting means that detects whether or not the time-limiting switch is on is additionally provided, and, when the controlling means judges the time-limiting switch to be off according to the result of detection by the detecting means, the controlling means turns off the switching means according to the phase of the supply voltage as monitored by the phase monitoring means.

Thus, it is possible to obtain the same benefits as described above.

To achieve the above object, in another aspect of the present invention, a high-frequency heating apparatus is provided with: a high-frequency oscillator; a high-voltage transformer that supplies electric power appearing at the secondary side thereof to the high-frequency oscillator; a time-limiting device including heating duration setting means that permits a heating duration to be set according to the amount of displacement by which the heating duration setting means is displaced and that indicates the remaining heating duration by letting the amount of displacement vary as the heating duration passes by, the amount of displacement returning to the initial value when the set heating duration has elapsed, and a time-limiting switch that turns on or off when the heating duration is set; switching means that controls the supply of a supply voltage to the primary side of the high-voltage transformer; and controlling means including means for monitoring the phase of the supply voltage and means for judging whether or not a heating duration is set or not by detecting whether the time-limiting switch is on or off, the controlling means, if a heating duration is set, turning on the switching means according to the phase of the supply voltage.

With this configuration, the provision of the controlling means that turns on the switching means according to the phase of the supplied voltage helps reduce rush current. This permits the switching means to have a lower rated current capacity, and thus helps achieve lower cost. Moreover, the time-limiting device permits the remaining heating duration to be indicated on an analog basis, and thus eliminates the need to provide a display device. In this way, it is possible to realize an inexpensive high-frequency heating apparatus that permits the user to visually recognize the remaining heating duration.

In either of the high-frequency heating apparatuses described above, advisably, when the absolute value of the supply voltage is at the maximum, the controlling means turns the switching means from off to on, and, when the supply voltage crosses the zero-Volt level, the controlling means turns the switching means from on to off.

Thus, the controlling means turns the switching means from off to on when the absolute value of the supply voltage is at the maximum, and this helps reduce rush current. Moreover, the controlling means turns the switching means from on to off when the supply voltage crosses the zero-Volt level, and this prevents electric discharge from occurring at the contacts of the switching means when it turns from on to off, greatly enhancing the durability of the switching means.

In either of the high-frequency heating apparatuses described above, advisably, the controlling means turns the switching means on and off with a predetermined duty factor. This makes it possible to produce desired high-frequency output.

In either of the high-frequency heating apparatuses described above, advisably, high-frequency heating output setting means that sets the high-frequency heating output is additionally provided, and the controlling means varies the duty factor according to the output signal of the high-frequency heating output setting means. This makes it possible to adjust the high-frequency heating output.

In either of the high-frequency heating apparatuses described above, advisably, the time-limiting switch only controls the supply of electric power to the electric circuit that needs to operate when high-frequency heating is performed.

With this configuration, the time-limiting switch only controls the supply of electric power to the electric circuit that needs to operate when high-frequency heating is performed. Thus, the current that is supplied to the high-voltage transformer does not flow through the time-limiting switch. This permits the time-limiting switch to be realized with a mechanical switch having a low rated current capacity, and thus helps achieve lower cost.

In either of the high-frequency heating apparatuses described above, advisably, the time-limiting device further includes a second time-limiting switch that, at the end of the heating duration, turns from on to off with a delay relative to the time-limiting switch, and the second time-limiting switch is connected in series with the switching means.

With this configuration, the time-limiting device further includes the second time-limiting switch that, at the end of the heating duration, turns from on to off with a delay relative to the time-limiting switch, and the second time-limiting switch is connected in series with the switching means. Thus, even if the controlling means becomes faulty, it is possible to end microwave heating. This helps enhance safety.

BRIEF DESCRIPTION OF DRAWINGS

FIG. 6 is a diagram showing the configuration of a conventional microwave oven.

BEST MODE FOR CARRYING OUT THE INVENTION

Hereinafter, embodiments of the present invention will be described with reference to the accompanying drawings. In the following description, microwave ovens will be taken up as examples of high-frequency heating apparatuses according to the invention.

First Embodiment

Figure 1:
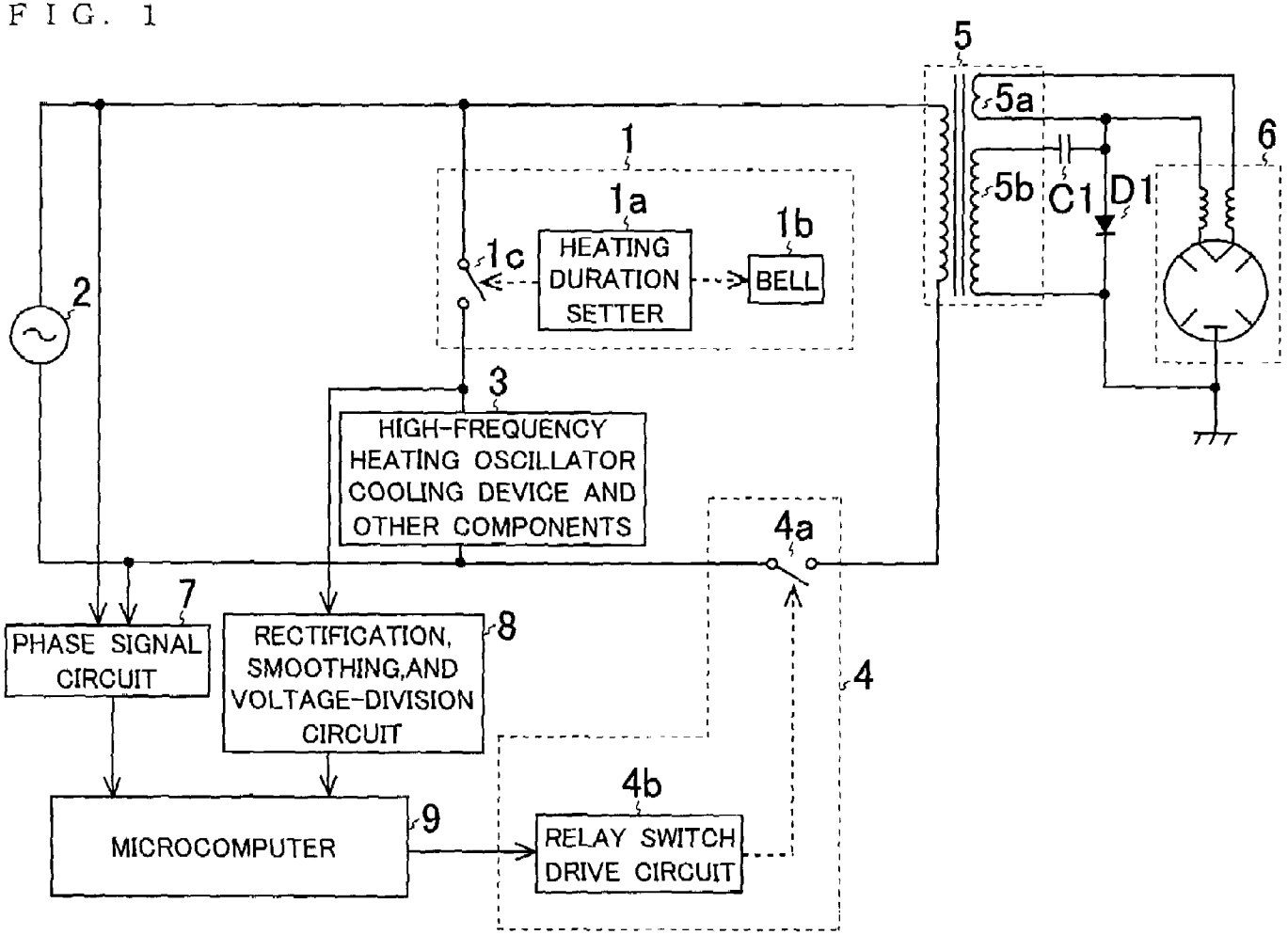
FIG. 1 is a diagram showing the configuration of the microwave oven of the first embodiment of the invention.

The configuration of the microwave oven of the first embodiment of the invention is shown in FIG. 1. Here, such components as are found also in the microwave oven shown in FIG. 6 are identified with common reference numerals.

A mechanical time-limiting device 1 has the following components assembled into a unit: a heating duration setter 1*a*, a bell 1*b*, and a mechanical switch functioning as a time-limiting switch 1*c*.

One end of commercial alternating-current power source 2 is connected via a relay switch 4*a* to one end of a primary coil of a high-voltage transformer 5. On the other hand, the other end of the commercial alternating-current power source 2 is connected directly to the other end of the primary coil of the high-voltage transformer 5.

One end of high-frequency heating oscillator cooling device and other components 3 is connected to the node between the commercial alternating-current power source 2 and the relay switch 4*a*, and the other end of the high-frequency heating oscillator cooling device and other components 3 is connected via the time-limiting switch 1*c* to the node between the other end of the commercial alternating-current power source 2 and the other end of the primary coil of the high-voltage transformer 5. Moreover, the input side of a phase signal circuit 7 is connected directly to both ends of the commercial alternating-current power source 2, and the output side of the phase signal circuit 7 is connected to a microcomputer 9.

Furthermore, the input side of a rectification, smoothing, and voltage-division circuit 8 is connected to the node between the time-limiting switch 1*c* and the high-frequency heating oscillator cooling device and other components 3, and the output side of the rectification, smoothing, and voltage-division circuit 8 is connected to the microcomputer 9. The microcomputer 9 is connected to a drive circuit 4*b* for driving the relay switch 4*a*.

The components that are connected to the secondary side of the high-voltage transformer 5 are the same as in the microwave oven shown in FIG. 6, and therefore their explanations will be omitted.

Now, the operation of the microwave oven configured as described above will be described. The heating duration setter 1*a* has a rotary knob (not illustrated). When the user rotates the rotary knob clockwise, the heating duration setter 1*a* sets a heating duration commensurate with the amount of rotation. As the heating duration passes by, the rotary knob rotates counter-clockwise by a rotation angle commensurate with the lapsed time, thereby indicating the remaining heating duration on an analog basis. The time-limiting switch 1*c* remains on during the heating duration, and otherwise remains off. At the end of the heating duration, the bell 1*b* sounds.

The phase signal circuit 7 receives from the commercial alternating-current power source 2 an alternating-current voltage, produces a phase signal that represents the phase of the alternating-current voltage, and feeds the thus-produced phase signal to the microcomputer 9.

When the time-limiting switch 1*c* is on, i.e. during the heating duration, alternating-current electric power is supplied from the commercial alternating-current power source 2 to the high-frequency heating oscillator cooling device and other components 3, so that the high-frequency heating oscillator cooling device and other components 3 operate.

Moreover, when the time-limiting switch 1*c* is on, i.e. during the heating duration, an alternating-current voltage is supplied from the commercial alternating-current power source 2 to the rectification, smoothing, and voltage-division circuit 8. The rectification, smoothing, and voltage-division circuit 8 includes a rectification diode, a smoothing capacitor, and voltage-division resistors, and, when supplied with the alternating-current voltage, feeds a direct-voltage signal having a predetermined value to the microcomputer 9, which functions as a controlling means.

The microcomputer 9 is supplied with stabilized direct-current electric power from a regulator (not illustrated), and is kept energized all the time.

The microcomputer 9 judges whether a heating duration is set or not according to the direct-current signal output from the rectification, smoothing, and voltage-division circuit 8. When a heating duration is recognized to be set, the microcomputer 9 turns the relay switch 4*a* from off to on at the moment when the phase of the output voltage of the commercial alternating-current power source 2 is such that rush current is minimal (i.e. the phase is such that the absolute value of the output voltage is maximal). The microcomputer 9 does this according to the phase signal output from the phase signal circuit 7, and taking into consideration the delay that accompanies the operation of the drive circuit 4*b* for driving the relay switch 4*a*. When the set heating duration has elapsed, the microcomputer 9 turns the relay switch 4*a* from on to off at the moment when the output voltage of the commercial alternating-current power source 2 crosses the zero-Volt level, and holds the relay switch 4*a* off. The microcomputer 9 does this according to the phase signal output from the phase signal circuit 7, and taking into consideration the delay that accompanies the operation of the drive circuit 4*b* for driving the relay switch 4*a*. All the while in between, the microcomputer 9 keeps turning the relay switch 4*a* on and off with a predetermined duty factor.

When the relay switch 4*a* is on, electric power is supplied from the commercial alternating-current power source 2 to the high-voltage transformer 5, and thus a high voltage of about 4 kV appears at the secondary side of the high-voltage transformer 5. This high voltage is supplied to a magnetron 6, so that the magnetron 6 oscillates a microwave. A target to be heated is irradiated with this microwave, and is thereby heated. Here, as described above, the relay switch 4*a* turns from off to on at the moment when rush current is minimal, and this helps greatly enhance the durability of the relay switch 4*a*. On the other hand, when the relay switch 4*a* is off, no electric power is supplied from the commercial alternating-current power source 2 to the high-voltage transformer 5, so that the magnetron 6 oscillates no microwave. Thus, the microwave output is determined by the duty factor mentioned above. Here, as described above, the relay switch 4*a* turns from on to off at the moment when the output voltage of the commercial alternating-current power source 2 crosses the zero-Volt level, and this prevents electric discharge from occurring at the contacts of the relay switch 4*a*, greatly enhancing the durability of the relay switch 4*a*.

Moreover, the current that is supplied to the high-voltage transformer 5 does not flow through the time-limiting switch 1*c*; therefore, only a small current flows through the time-limiting switch 1*c*. This makes it possible to realize the time-limiting switch 1*c* with a mechanical switch having a low rated current capacity, and thus helps achieve lower cost.

Moreover, smaller rush current makes it possible to realize the relay switch 4*a* with a switch having a lower rated current capacity than the conventionally used time-limiting switches 1*e* and 1*f* (see FIG. 6). This helps achieve lower cost.

Moreover, it is possible, without the use of a display device, to make the mechanical time-limiting device 1 indicate the remaining heating duration. This makes it possible to realize an inexpensive microwave oven that permits the user to visually recognize the remaining heating duration.

Alternatively, the microcomputer 9 may start measuring time with a timer incorporated therein at the start of heating in order to monitor the lapse of a predetermined period so that, after the timer has recognized the lapse of the predetermined period, the microcomputer 9 keeps the relay switch 4*a* off irrespective of whether or not the direct-current voltage signal from the rectification, smoothing, and voltage-division circuit 8 is present. In this case, advisably, the predetermined period mentioned above is set to be longer than the maximum value of the heating duration that can be set on the heating duration setter 1*a*. By so doing, even if the mechanical time-limiting device 1 becomes faulty and leaves the time-limiting switch 1*c* on even after the end of the heating duration, the microcomputer 9, after the lapse of the predetermined period, can turn the relay switch 4*a* off and end microwave heating.

Second Embodiment

Figure 2:
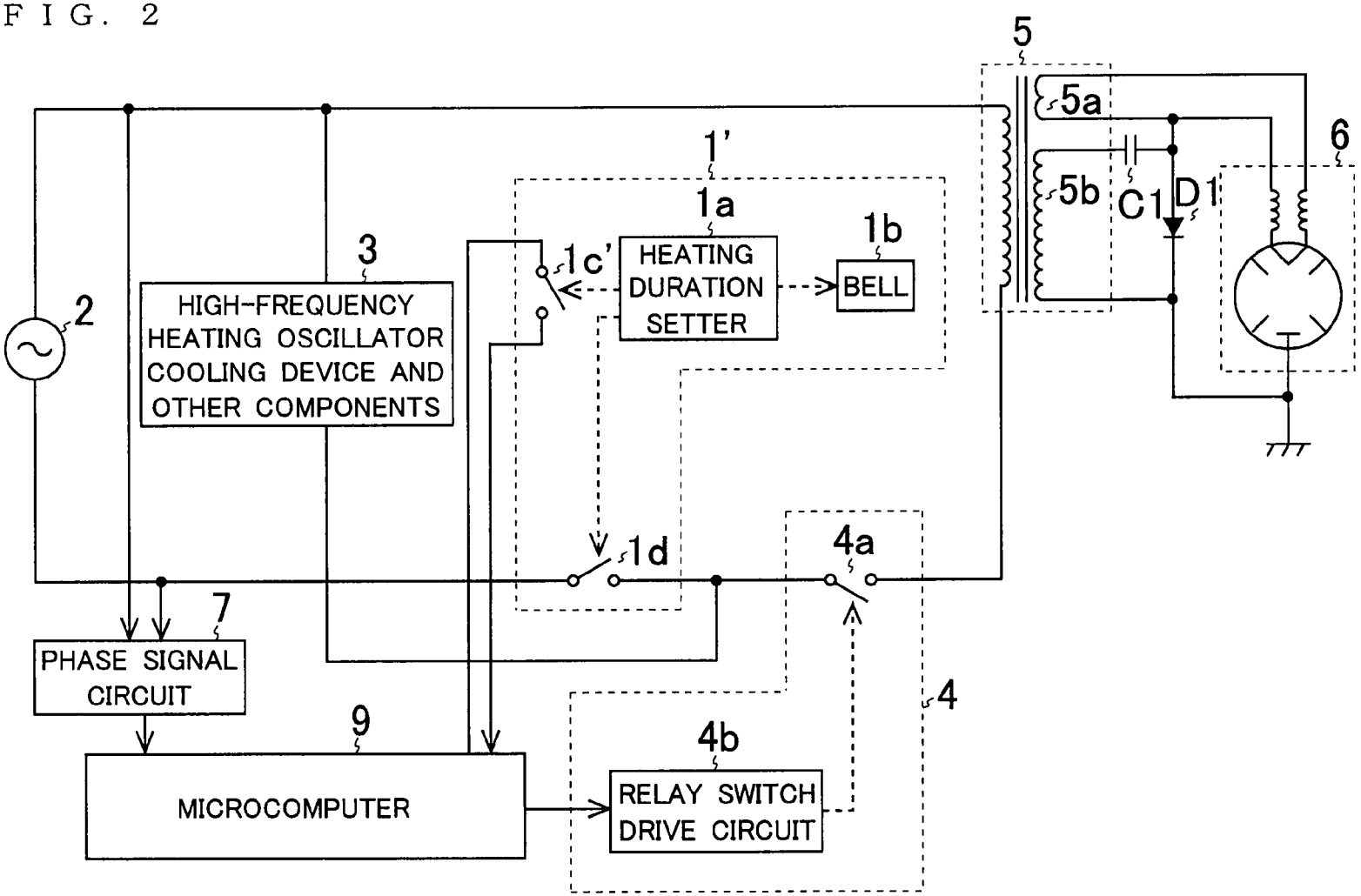
FIG. 2 is a diagram showing the configuration of the microwave oven of the second embodiment of the invention.

The configuration of the microwave oven of the second embodiment of the invention is shown in FIG. 2. Here, such components as are found also in the microwave oven shown in FIG. 1 are identified with common reference numerals.

A mechanical time-limiting device 1' has the following components assembled into a unit: a heating duration setter 1*a*, a bell 1*b*, a mechanical switch functioning as a time-limiting switch 1*c*', and a mechanical switch functioning as a second time-limiting switch 1*d*.

One end of commercial alternating-current power source 2 is connected, via the second time-limiting switch 1*d* and a relay switch 4*a* in this order, to one end of a primary coil of a high-voltage transformer 5. On the other hand, the other end of the commercial alternating-current power source 2 is connected directly to the other end of the primary coil of the high-voltage transformer 5.

One end of high-frequency heating oscillator cooling device and other components 3 is connected to the node between the second time-limiting switch 1*d* and the relay switch 4*a*, and the other end of the high-frequency heating oscillator cooling device and other components 3 is connected to the node between the other end of the commercial alternating-current power source 2 and the other end of the primary coil of the high-voltage transformer 5. Moreover, the input side of a phase signal circuit 7 is connected directly to both ends of the commercial alternating-current power source 2, and the output side of the phase signal circuit 7 is connected to a microcomputer 9.

Furthermore, both ends of the time-limiting switch 1*c*' are connected to the microcomputer 9. The microcomputer 9 is connected to a drive circuit 4*b* for driving the relay switch 4*a*.

The components that are connected to the secondary side of the high-voltage transformer 5 are the same as in the microwave ovens shown in FIGS. 1 and 6, and therefore their explanations will be omitted.

Now, the operation of the microwave oven configured as described above will be described. The heating duration setter 1*a* has a rotary knob (not illustrated). When the user rotates the rotary knob clockwise, the heating duration setter 1*a* sets a heating duration commensurate with the amount of rotation. As the heating duration passes by, the rotary knob rotates counter-clockwise by a rotation angle commensurate with the lapsed time, thereby indicating the remaining heating duration on an analog basis. The time-limiting switch 1*c*' and the second time-limiting switch 1*d* remain on when a heating duration is set, and otherwise remain off. Here, the second time-limiting switch 1*d* is a mechanical switch that, at the end of the heating duration, turns from on to off with a predetermined length of delay (several seconds) relative to the timing with which the time-limiting switch 1*c*' turns from on to off. This can be achieved by differentiating the shape of the cam that operates the time-limiting switch 1*c*' from the shape of the cam that operates the second time-limiting switch 1*d*. At the end of the heating duration, the bell 1*b* sounds. The time-limiting switch 1*c*' may be of the type that remains off when a heating duration is set.

The phase signal circuit 7 receives from the commercial alternating-current power source 2 an alternating-current voltage, produces a phase signal that represents the phase of the alternating-current voltage, and feeds the thus produced phase signal to the microcomputer 9.

When the second time-limiting switch 1*d* is on, i.e. during the heating duration, alternating-current electric power is supplied from the commercial alternating-current power source 2 to the high-frequency heating oscillator cooling device and other components 3, so that the high-frequency heating oscillator cooling device and other components 3 operate. Moreover, when the time-limiting switch 1*c*' is on, i.e. during the heating duration, a short-circuit signal is fed via the time-limiting switch 1*c*' to the microcomputer 9.

The microcomputer 9 is supplied with stabilized direct-current electric power from a regulator (not illustrated), and is kept energized all the time.

The microcomputer 9 judges whether a heating duration is set or not according to the short-circuit signal generated when the time-limiting switch 1*c*' turns on.

When a heating duration is recognized to be set, the microcomputer 9 turns the relay switch 4*a* from off to on at the moment when the phase of the output voltage of the commercial alternating-current power source 2 is such that rush current is minimal (i.e. the phase is such that the absolute value of the output voltage is maximal). The microcomputer 9 does this according to the phase signal output from the phase signal circuit 7, and taking into consideration the delay that accompanies the operation of the drive circuit 4*b* for driving the relay switch 4*a*.

At the end of the set heating duration, the microcomputer 9 turns the relay switch 4*a* from on to off at the moment when the output voltage of the commercial alternating-current power source 2 crosses the zero-Volt level, and holds the relay switch 4*a* off. The microcomputer 9 does this according to the phase signal output from the phase signal circuit 7, and taking into consideration the delay that accompanies the operation of the drive circuit (not illustrated) for driving the switch 4. Then, as described above, after the end of the heating duration, the second time-limiting switch 1*d* turns off with the predetermined length of delay (several seconds) relative to the time-limiting switch 1*c*'. This length of delay is set to be sufficiently long to permit the relay switch 4*a* to be held off after the end of the heating duration. Thus, after the end of the heating duration, first the relay switch 4*a* turns off, and thereafter the second time-limiting switch 1*d* turns off. This prevents electric discharge from occurring at the contacts of the second time-limiting switch 1*d* when it turns from on to off, and thus helps greatly enhance the durability of the second time-limiting switch 1*d*.

Alternatively, the microcomputer 9 may start measuring time with a timer incorporated therein at the start of heating in order to monitor the lapse of a predetermined period so that, after the timer has recognized the lapse of the predetermined period, the microcomputer 9 keeps the relay switch 4*a* off irrespective of whether or not the short-circuit signal is present. In this case, advisably, the predetermined period mentioned above is set to be longer than the maximum value of the heating duration that can be set on the heating duration setter 1*a*. By so doing, even if the mechanical time-limiting device 1 becomes faulty and leaves the time-limiting switch 1*c*' and the second time-limiting switch 1*d* on even after the end of the heating duration, the microcomputer 9, after the lapse of the predetermined period, can turn the relay switch 4*a* off and end microwave heating.

Moreover, even if the microcomputer 9 becomes faulty and leaves the relay switch 4*a* on even after the end of the heating duration, or if the relay switch 4*a* becomes fused, the mechanical time-limiting device 1' can, after the end of the heating duration, turn the time-limiting switch 1*d* off and end microwave heating.

In this way, in the microwave oven shown in FIG. 2, even if either of the microcomputer 9 and the mechanical time-limiting device 1' becomes faulty, microwave heating can be ended. This helps enhance safety.

The microwave oven shown in FIG. 2, as compared with the microwave oven shown in FIG. 1, requires the additional provision of the second time-limiting switch 1*d* but does not require the rectification, smoothing, and voltage-division circuit 8. Thus, in terms of cost, the microwave oven of FIG. 2 roughly compares with that of FIG. 1.

Third Embodiment

Figure 3:
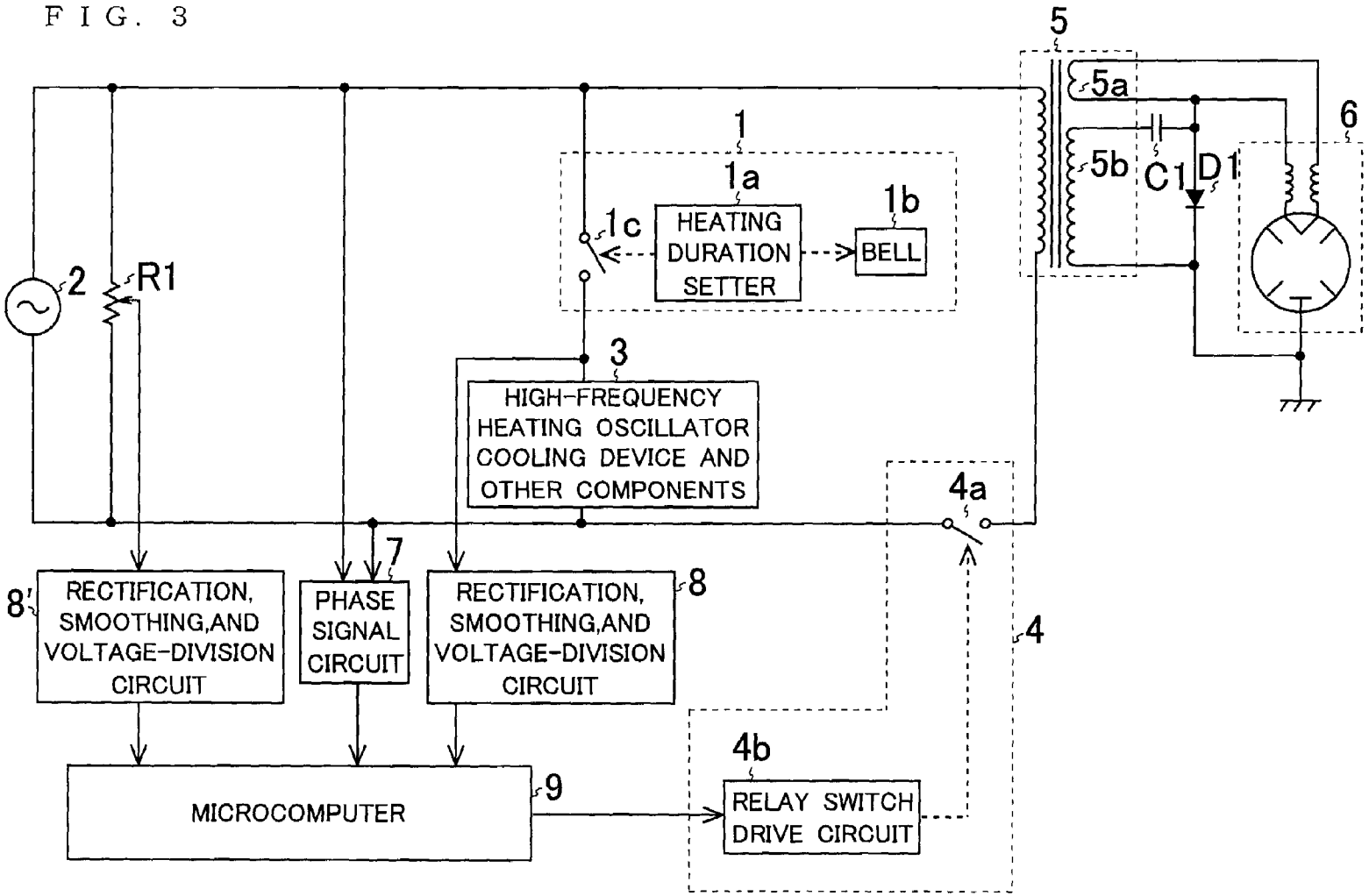
FIG. 3 is a diagram showing the configuration of the microwave oven of the third embodiment of the invention.

The configuration of the microwave oven of the third embodiment of the invention is shown in FIG. 3. Here, such components as are found also in the microwave oven shown in FIG. 1 are identified with common reference numerals.

The microwave oven of the third embodiment, as compared with the microwave oven of the first embodiment described earlier, is additionally provided with a variable-contact resistor R1. One end of the variable-contact resistor R1 is connected to one end of the commercial alternating-current power source 2, and the other end of the variable-contact resistor R1 is connected to the other end of the commercial alternating-current power source 2. The movable contact of the variable-contact resistor R1 is connected via a rectification, smoothing, and voltage-division circuit 8' to the microcomputer 9. The user can operate the variable-contact resistor R1 to change the position of the movable contact thereof. The alternating-current voltage at the movable contact of the variable-contact resistor R1 is converted into a direct-current voltage by the rectification, smoothing, and voltage-division circuit 8', and is then fed to the microcomputer 9. According to this direct-current voltage, the microcomputer 9 varies the duty factor with which it turns the relay switch 4*a* on and off. This makes it possible to adjust the microwave output.

Fourth Embodiment

Figure 4:
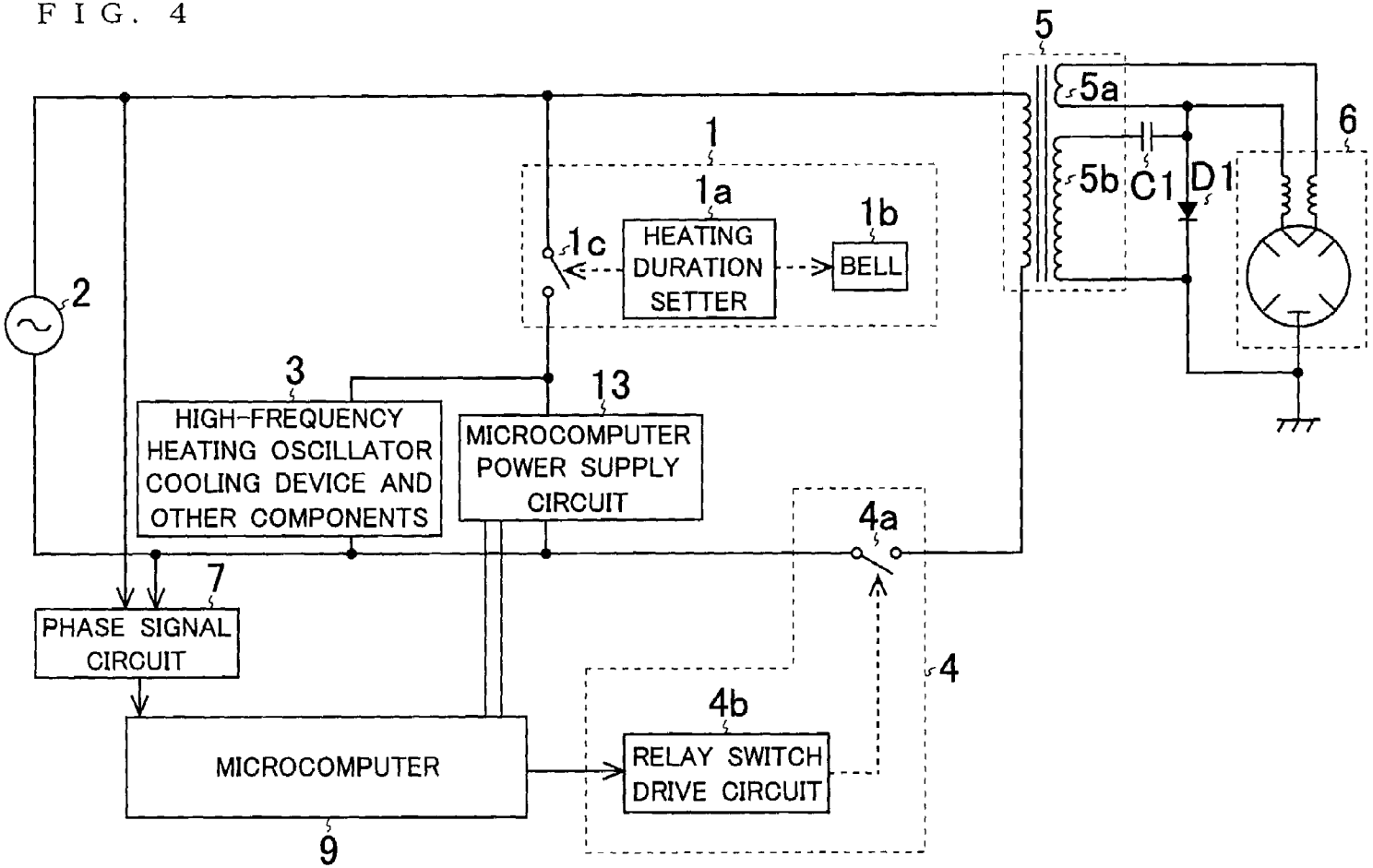
FIG. 4 is a diagram showing the configuration of the microwave oven of the fourth embodiment of the invention.

The configuration of the microwave oven of the fourth embodiment of the invention is shown in FIG. 4. Here, such components as are found also in the microwave oven shown in FIG. 1 are identified with common reference numerals.

Whereas, in the microwave oven shown in FIG. 1, the microcomputer 9 is kept energized all the time, in the microwave oven shown in FIG. 4, the microcomputer 9 is energized only when a heating duration is set on the mechanical time-limiting device 1. This is the most significant difference between these microwave ovens. To achieve this, the rectification, smoothing, and voltage-division circuit 8 used in the microwave oven shown in FIG. 1 is here replaced with a microcomputer power supply circuit 13, which corresponds to what is referred to as the regulator (not illustrated) in the microwave oven shown in FIG. 1. One input of the microcomputer power supply circuit 13 is connected to the node between the commercial alternating-current power source 2 and the relay switch 4*a*, and another input of the microcomputer power supply circuit 13 is connected via the time-limiting switch 1*c* to the node between the other end of the commercial alternating-current power source 2 and the other end of the primary coil of the high-voltage transformer 5. The output side of the microcomputer power supply circuit 13 is connected to the microcomputer 9.

Now, an outline of the operation of the microwave oven configured as described above will be described, with emphasis placed on differences from the microwave oven shown in FIG. 1. When a heating duration is set, the time-limiting switch 1*c* turns on, and thus an alternating-current voltage is supplied from the commercial alternating-current power source 2 to the high-frequency heating oscillator cooling device and other components 3 and to the microcomputer power supply circuit 13. When supplied with the alternating-current voltage from the commercial alternating-current power source 2, the microcomputer power supply circuit 13 supplies direct-current electric power to the microcomputer 9, so that the microcomputer 9 is energized.

When the electric power supplied to the microcomputer 9 becomes higher than the operating voltage thereof, the microcomputer 9 is reset, and starts executing the program incorporated therein. Specifically, the microcomputer 9 turns the relay switch 4*a* from off to on at the moment when the phase of the output voltage of the commercial alternating-current power source 2 is such that the rush current is minimal (i.e. the phase is such that the absolute value of the output voltage is maximal). The microcomputer 9 does this according to the phase signal output from the phase signal circuit 7, and taking into consideration the delay that accompanies the operation of the relay switch drive circuit 4*b*.

At the end of the set heating duration, the time-limiting switch 1*c* turns off. When the time-limiting switch 1*c* turns off, the output voltage of the microcomputer power supply circuit 13 gradually decreases until it ultimately becomes zero. When the output voltage of the microcomputer power supply circuit 13 becomes lower than a previously set threshold value (for example, equal to 80% of the output voltage obtained when the time-limiting switch 1*c* is on), the microcomputer 9 recognizes the end of the heating duration, and thus turns the relay switch 4*a* from on to off at the moment when the output voltage of the commercial alternating-current power source 2 crosses the zero-Volt level, and holds the relay switch 4*a* off. The microcomputer 9 does this according to the phase signal output from the phase signal circuit 7, and taking into consideration the delay that accompanies the operation of the relay switch drive circuit 4*b*. Thereafter, when the output voltage of the microcomputer power supply circuit 13 becomes lower than the minimum operating voltage of the microcomputer 9, the microcomputer 9 stops its operation.

When the relay switch 4*a* is on, electric power is supplied from the commercial alternating-current power source 2 to the high-voltage transformer 5, and thus a high voltage appears at the secondary side of the high-voltage transformer 5. This high voltage is supplied to the magnetron 6, so that the magnetron 6 oscillates a microwave. A target to be heated is irradiated with this microwave, and is thereby heated.

In the microwave oven shown in FIG. 4, the microcomputer 9 is not kept energized all the time. This helps save electric power. In addition, quite naturally, the microwave oven shown in FIG. 4 gives the same benefits as the microwave oven shown in FIG. 1. In the microwave oven shown in FIG. 4, the microcomputer 9 refers to the output voltage of the microcomputer power supply circuit 13 to detect whether or not the time-limiting switch 1*c* is off to recognize the end of the heating duration. Alternatively, it is also possible, for example, to provide a separate rectification, smoothing, voltage-division circuit that receives the voltage at the node between the time-limiting switch 1*c* and the microcomputer power supply circuit 13, that then rectifies, smooths, and divides that voltage to convert it into a direct-current voltage, and that then feeds the resulting direct-current voltage to the microcomputer 9. In this case, according to the output of this rectification, smoothing, voltage-division circuit, the microcomputer 9 detects whether or not the time-limiting switch 1*c* is off to recognize the end of the heating duration.

Fifth Embodiment

Figure 5:
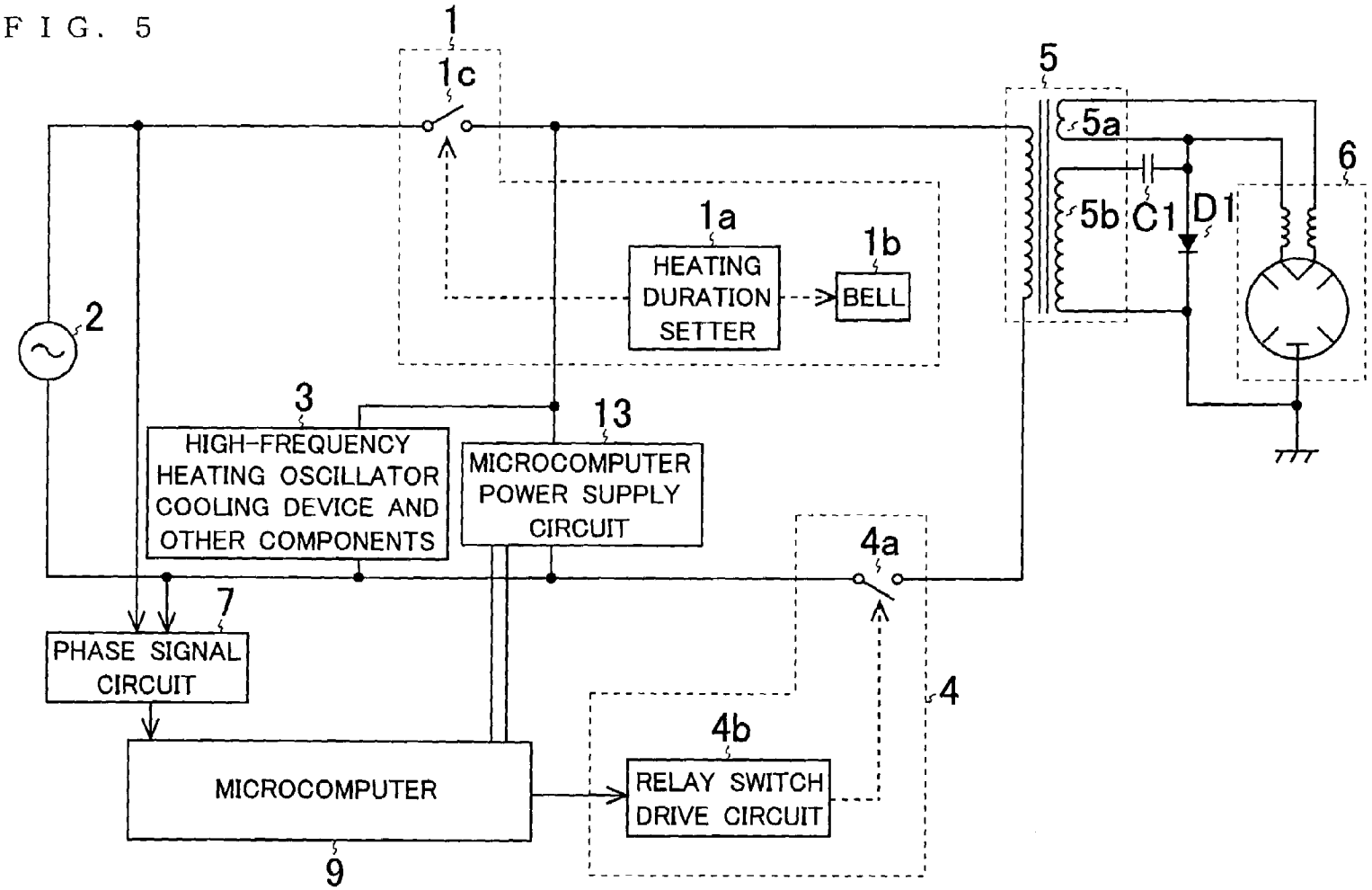
FIG. 5 is a diagram showing the configuration of the microwave oven of the fifth embodiment of the invention.

FIG. 5 shows, as another feasible example, the microwave oven of the fifth embodiment of the invention. Here, the time-limiting switch 1*c* is provided between the commercial alternating-current power source 2 and the node among the high-frequency heating oscillator cooling device and other components 3, high-voltage transformer 5, and microcomputer power supply circuit 13. That is, the relay switch 4*a* is not controlled at the end of the heating duration.

The microcomputer 9 in the microwave oven shown in FIG. 5 is not kept energized all the time, in the same way as in the microwave oven shown in FIG. 4. This helps save electric power.

INDUSTRIAL APPLICABILITY

High-frequency heating apparatuses according to the present invention shall find applications in various kinds of apparatuses capable of high-frequency heating, including but not limited to microwave ovens.

What is claimed is:

1. A high-frequency heating apparatus comprising:

a high-frequency oscillator;

a high-voltage transformer that supplies electric power appearing at a secondary side thereof to the high-frequency oscillator;

switching means that switches whether to supply or not to supply electric power to a primary side of the high-voltage transformer;

a time-limiting device including heating duration setting means that permits a heating duration to be set according to an amount of displacement by which the heating duration setting means is displaced forward and that is displaced backward as the heating duration passes by, and a time-limiting switch that turns from off to on when the heating duration is set and that turns from on to off when the amount of displacement returns to an initial value;

phase monitoring means that monitors a phase of the supply voltage; and controlling means that is fed with electric power when the time-limiting switch is on and that controls the switching means according to the phase of the supply voltage as monitored by the phase monitoring means.

2. The high-frequency heating apparatus of claim 1, wherein, when the controlling means judges the time-limiting switch to be off according to a value of a voltage supplied when the time-limiting switch is on, the controlling means turns off the switching means according to the phase of the supply voltage as monitored by the phase monitoring means.

3. The high-frequency heating apparatus of claim 1, further comprising:

detecting means that detects whether or not the time-limiting switch is off, wherein, when the controlling means judges the time-limiting switch to be off according to a result of detection by the detecting means, the controlling means turns off the switching means according to the phase of the supply voltage as monitored by the phase monitoring means.

4. The high-frequency heating apparatus of claim 1, wherein, when an absolute value of the supply voltage is at a maximum, the controlling means turns the switching means from off to on, and, when the supply voltage crosses a zero-Volt level, the controlling means turns the switching means from on to off.

5. The high-frequency heating apparatus of claim 4, further comprising:

high-frequency heating output setting means that sets high-frequency heating output, wherein the controlling means turns the switching means on and off with a duty factor according to an output signal of the high-frequency heating output setting means, wherein the time-limiting switch only controls supply of electric power to an electric circuit that needs to operate as high-frequency heating is performed, wherein the time-limiting device further includes a second time-limiting switch that, at an end of the heating duration, turns from on to off with a delay relative to the time-limiting switch, and wherein the second time-limiting switch is connected in series with the switching means.

6. The high-frequency heating apparatus of claim 1, wherein the controlling means turns the switching means on and off with a predetermined duty factor.

7. The high-frequency heating apparatus of claim 6, further comprising:

high-frequency heating output setting means that sets high-frequency heating output, wherein the controlling means varies the duty factor according to an output signal of the high-frequency heating output setting means.

8. The high-frequency heating apparatus of claim 1 wherein the time-limiting switch only controls supply of electric power to an electric circuit that needs to operate as high-frequency heating is performed.

9. The high-frequency heating apparatus of claim 1, wherein the time-limiting device further includes a second time-limiting switch that, at an end of the heating duration, turns from on to off with a delay relative to the time-limiting switch, and wherein the second time-limiting switch is connected in series with the switching means.

10. A high-frequency heating apparatus comprising:

a high-frequency oscillator;

a high-voltage transformer that supplies electric power appearing at a secondary side thereof to the high-frequency oscillator;

a time-limiting device including heating duration setting means that permits a heating duration to be set according to an amount of displacement by which the heating duration selling means is displaced and that indicates a remaining heating duration by letting the amount of displacement vary as the heating duration passes by, the amount of displacement returning to an initial value when the set heating duration has elapsed, and a time-limiting switch that turns on or off when the heating duration is set;

switching means that controls supply of a supply voltage to a primary side of the high-voltage transformer; and controlling means including means for monitoring a phase of the supply voltage and means for judging whether or not a heating duration is set or not by detecting whether the time-limiting switch is on or off, the controlling means, if a heating duration is set, turning on the switching means according to the phase of the supply voltage.

11. The high-frequency heating apparatus of claim 10, wherein, when an absolute value of the supply voltage is at a maximum, the controlling means turns the switching means from off to on, and, when the supply voltage crosses a zero-Volt level, the controlling means turns the switching means from on to off.

12. The high-frequency heating apparatus of claim 11, further comprising:

high-frequency heating output setting means that sets high-frequency heating output, wherein the controlling means turns the switching means on and off with a duty factor according to an output signal of the high-frequency heating output setting means, wherein the time-limiting switch only controls supply of electric power to an electric circuit that needs to operate as high-frequency heating is performed, wherein the time-limiting device further includes a second time-limiting switch that, at an end of the heating duration, turns from on to off with a delay relative to the time-limiting switch, and wherein the second time-limiting switch is connected in series with the switching means.

13. The high-frequency heating apparatus of claim 10, wherein the controlling means turns the switching means on and off with a predetermined duty factor.

14. The high-frequency heating apparatus of claim 12, further comprising:

high-frequency heating output setting means that sets high-frequency heating output, wherein the controlling means varies the duty factor according to an output signal of the high-frequency heating output setting means.

15. The high-frequency heating apparatus of claim 10, wherein the time-limiting switch only controls supply of electric power to an electric circuit that needs to operate as high-frequency heating is performed.

16. The high-frequency heating apparatus of claim 10, wherein the time-limiting device further includes a second time-limiting switch that, at an end of the heating duration, turns from on to off with a delay relative to the time-limiting switch, and wherein the second time-limiting switch is connected in series with the switching means.

* * * * *